US005464312A

United States Patent [19]

Hotkowski et al.

[11] Patent Number: 5,464,312

[45] Date of Patent: Nov. 7, 1995

[54] AUTOMATIC BINDER

[75] Inventors: Peter Hotkowski, Chester; Peter Burton, East Hadden, both of Conn.

[73] Assignee: General Binding Corporation, Northbrook, Ill.

[21] Appl. No.: 240,257

[22] Filed: May 10, 1994

[51] Int. Cl.[6] ..... B42B 9/00

[52] U.S. Cl. ..... 412/7; 412/40

[58] Field of Search ..... 412/7, 40; 221/239, 221/260

[56] References Cited

U.S. PATENT DOCUMENTS

| | | |
|---|---|---|
| 3,125,887 | 7/1960 | Bouvier et al. . |
| 3,227,023 | 11/1961 | Bouvier . |
| 3,475,775 | 3/1967 | Staats . |
| 3,544,411 | 4/1967 | Staats . |
| 3,583,557 | 6/1971 | Staats . |
| 3,761,983 | 10/1973 | Staats . |
| 4,320,547 | 3/1982 | Stolle et al. . |
| 4,645,399 | 2/1987 | Scharer . |

FOREIGN PATENT DOCUMENTS

| | | |
|---|---|---|
| 2448082 | 4/1976 | Germany . |
| 2230822 | 9/1978 | Germany . |

*Primary Examiner*—S. Thomas Hughes
*Attorney, Agent, or Firm*—Hill, Steadman & Simpson

[57] ABSTRACT

An apparatus and method for installing binder elements onto a stack of pre-punched paper including a platform for holding the paper, reciprocating guide fingers for inserting through the pre-punched holes to engage free ends of curled fingers of the binder element whereas the spine part of the binder element is restrained by a holder which moves laterally to spread apart the curled fingers. The spread apart curled fingers then are flattened and driven upwardly through the holes as the guide fingers retreat upwardly and thereafter separate from the curled fingers to complete the binding of the pages.

22 Claims, 6 Drawing Sheets

AUTOMATIC BINDER

BACKGROUND OF THE INVENTION

The present invention relates to an apparatus and method for loading hole punched paper onto a curled finger binding element such as commercial CERLOX® binding elements such as disclosed in U.S. Pat. No. 3,583,557. Manually operated binding machines which open ring elements and load paper onto the elements are disclosed by U.S. Pat. Nos. 4,645,399, 3,125,887, and 3,227,023. The devices described by these patents rely somewhat on the operator's skill and dexterity at positioning portions of the documents and advancing the closure of the binding element in properly judged stages. These machines are not fully automatic.

SUMMARY OF THE INVENTION

It is an object of the present invention to provide an apparatus and method for the automated loading of hole punched stacks of paper onto a binding element having a lengthwise spine connecting a plurality of curled fingers, to be bound thereby. It is an object of the present invention to provide an apparatus which accurately positions and supports a stack of hole punched sheets for binding by a curled finger binding element. It is an object of the invention to successively deliver binding elements to successive stacks of paper to be bound thereby. It is an object of the present invention to provide an apparatus which is simple in construction and operation and is flexible to accommodate varying page and binding element sizes.

The objects are inventively achieved by an automated binding apparatus and method providing a stationary platform or "platen" for holding a stack of sheets, an alignment stop and clamp for aligning and holding the sheets on the platen, a plurality of guide fingers for piercing the holes from one side thereof to engage curled fingers of the element, a device for holding a spine of the element and moving the spine laterally to open the curled fingers, and a device for flattening and driving the curled fingers through the holes.

The device for flattening and driving the thus flattened curled fingers can comprise a columnator for flattening the curled fingers against the guide fingers while driving the curled fingers toward and through the paper by a driver. The columnator has holes for receiving a plurality of stationary stabilizing fingers or pins. The stabilizing fingers guide the curled fingers against any transverse movement as they are opened. The platen provides a curved guide channel for helping introduce the thus flattened curled fingers into the pre-punched holes and for providing a final degree of flattening.

The device for holding the spine comprises a comb-shaped element holder which opposes lateral movement of the spine while allowing flattening of the curled fingers and an element spring which clamps the spine against the element holder.

The binding elements are delivered successively to the element holder by an element loading apparatus. The element loading apparatus receives a supply of elements secured to an elongate carrier, and successively removes the elements from the carrier and installs the elements onto the comb-shaped element holder. The carrier can be a fan-folded paper carrier driven by a tractor feed roller.

DETAILED DESCRIPTION OF THE PREFERRED EMBODIMENTS

Figure 1:
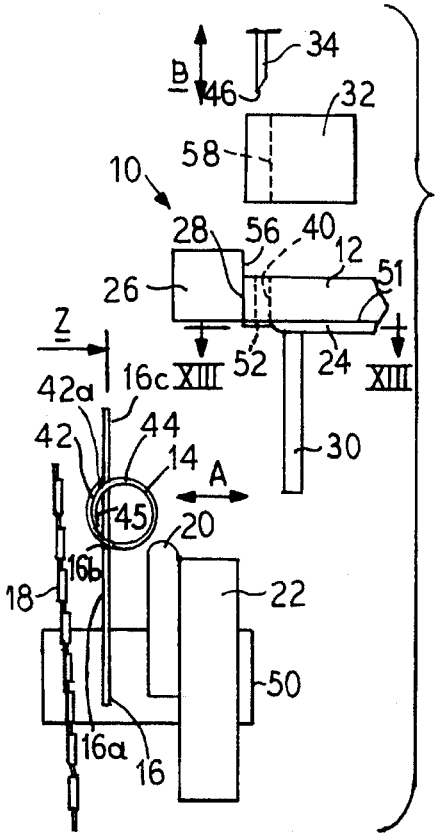
FIG. 1 is a schematic elevational view of an apparatus of the present invention.

FIG. 1 illustrates an apparatus 10 for binding a stack of paper 12 with a ring binding element 14. Such a ring binding element is disclosed for example in U.S. Pat. No. 3,583,557. The element is held on an element holder 16 between an element spring 18 and a driver 20 and columnator 22. A platen 24 supports the stack of paper 12. A movable back stop 26 for locating an edge 28 of the stack of pages 12, is provided. The back stop 26 is arranged to be movable away from the stack 12 once the stack 12 is properly aligned. Beneath the platen 24 is arranged a row of stabilizing fingers 30. Above the stack 12 is arranged a movable clamp 32 and a row of movable guide fingers 34.

The bind element 14 is typically a PVC plastic curled comb-type such as a CERLOX® binder or similar. To be installed though punched holes 40 in the stack of pages 12, the element is deformed and moved through the paper and allowed to return to its original shape to hold the pages together. The element consists of a spine 42 adjoining equally spaced fingers 44 which are curled into a circular form about an axis perpendicular to the fingers. It is advantageous for the binding operation that the bind element have tips 45 of its fingers 44 resting inside the edge of the spine at the start of the bind process.

The element holder 16 is typically a comb-shaped device for holding the element. The element holder translates a linear path A parallel to the plane of the document paper. The element spring 18 applies a spring force against the spine 42 of the element 14. The element spring can be a leaf spring in its simplistic configuration which exerts frictional force only, or an actuator released escapement acting as a retaining latch in a more complex version. A latch-type version is advantageous to resist the higher forces encountered when binding documents thicker than 0.6 inches thick.

The guide fingers 34 pass through the paper holes 40 and initiate the opening of the bind element 14 and retain the tips 45 of the bind element fingers 44 during opening and the driving of the bind element through the paper holes 40. The guide fingers move in a linear path B through an axis of the holes 40 in the stacked paper. The guide fingers are advantageously 0.03 inches (or more) smaller than the holes in the paper in both directions. The guide fingers advantageously have a concave feature on the surface facing away from the edge 28 of the paper. This feature must extend from a tip 46 of the guide fingers 34 to the level of the platen when the guide fingers 34 are in their lowest position. The guide fingers must be strong enough to resist permanent deformation from the spring force of the opened bind element 14 despite their length, although slight temporary deformation may be beneficial in that it loads the guide fingers against a back of the paper holes (toward the edge 28), thus providing maximum clearance in the front of the holes for the bind element fingers.

A holder carriage 50 shown schematically as a box couples the element holder, the columnator and the driver and moves the three components in a linear path parallel to the guide fingers in the direction B. The columnator 22 and the driver 20 are mounted to also slide relative to the holder carriage 50 and element holder 16. The element holder does not move relative to the holder carriage. In its furthest position below the paper, the holder carriage positions the element holder low enough so that a maximum size bind element finger 44 can be opened without interfering with the platen 24, but not so low as to require unnecessarily long guide fingers 34 that would be more subject to bending.

The stabilizing fingers 30 are advantageously fashioned as round dowels or pins that extend below the platen 24 parallel to the axis of the paper holes and on opposite side of the holes from the edge 28 of the paper. The stabilizing fingers are stationary components. These stabilizing fingers prevent any potential side to side (transverse) movement or skewing of the element fingers during opening, at the outer portions of their curl opposite the spine. The platen 24 provides a surface 51 for supporting the paper during the binding process, resisting the force of the clamp 32 on the paper. The platen is a stationary component. The platen provides notches 52 which allow the guide and element fingers to pass through and prevents the element fingers from entrapping themselves. A bottom surface of the platen provides a curved surface 54 to guide the curve of the fingers into the hole in the paper, this performing the final "flattening" of the binding element. The platen 24 is shown also in FIG. 13.

The back stop 26 provides a surface 56 parallel to the bind edge 28 of the document and perpendicular to the plane of the paper and aids in aligning the pre-punched paper. The back stop pivots out of the way after the paper is positioned. In its minimal form, the back stop is a pair of vertical lines defining a plane.

The clamp 32 provides notches 58 corresponding to the notches 52 in the platen 24 and corresponding to the holes 40 in the paper. The clamp retains the paper, counteracting the force of the bind element's tendency to push the paper as it is inserted into the holes. The clamp translates toward and away from the platen in the linear path B perpendicular to the plane of the paper. The notches 58 extend the counteracting force of the clamp to the edge of the document, but leaving access to the paper holes so as not to trap the bind element.

The columnator 22 flattens some of the curl of the bind element fingers 44 in preparation to drive them into the paper holes 40. The columnator translates the linear path B parallel to the guide fingers. The driver 20 pushes the bind element as it is inserted into the paper holes. The driver also translates the linear path B parallel to the guide fingers.

Figure 12:
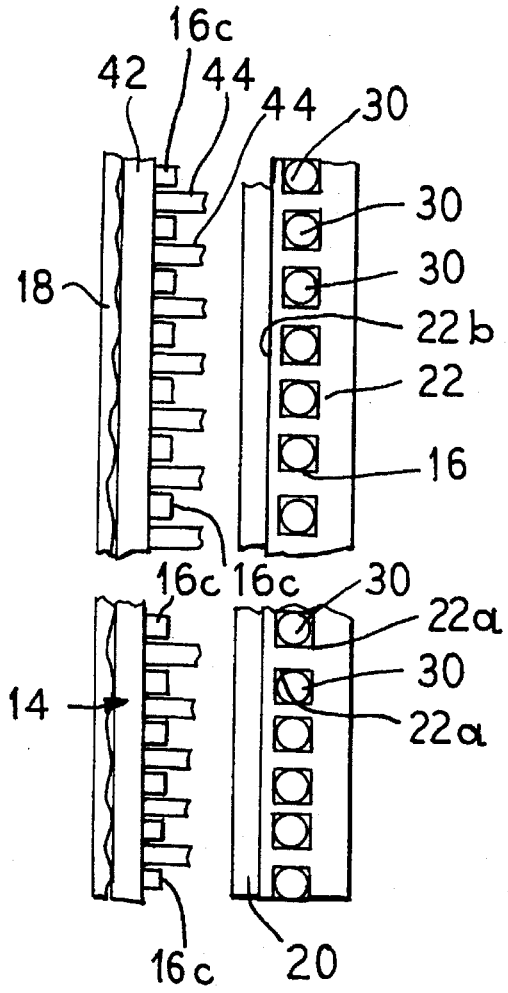
FIG. 12 is a sectional view taken generally along line XII—XII from FIG. 7.

FIG. 12 illustrates the transverse configuration of the components including the spring 18, the comb-shaped holder 16 having tines 16*c*, the driver 20, the dowel-shaped stabilizing fingers 30, and the columnator 22. The columnator 22 has a plurality of holes 22*a* in registry with the stabilizing fingers 30 to allow a meshing therewith during raising of the columnator. The columnator provides a continuous surface 22*b* for flattening the fingers during its upward travel. The holes 22*a* are shown as square, but can just as easily be round, sized to receive the stabilizing fingers 30. The element 14 is enmesh with the holder 16 and clamped by the spring 18.

Figure 13:
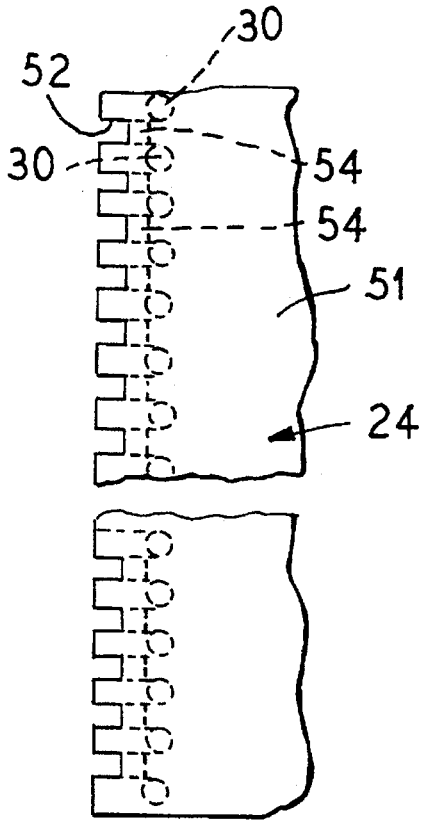
FIG. 13 is a sectional view taken generally along XII—XII from FIG. 1.

FIG. 13 illustrates the platen 24 with the notches 52, the curved wall portions 54 and the stabilizing fingers 30.

Figure 14:
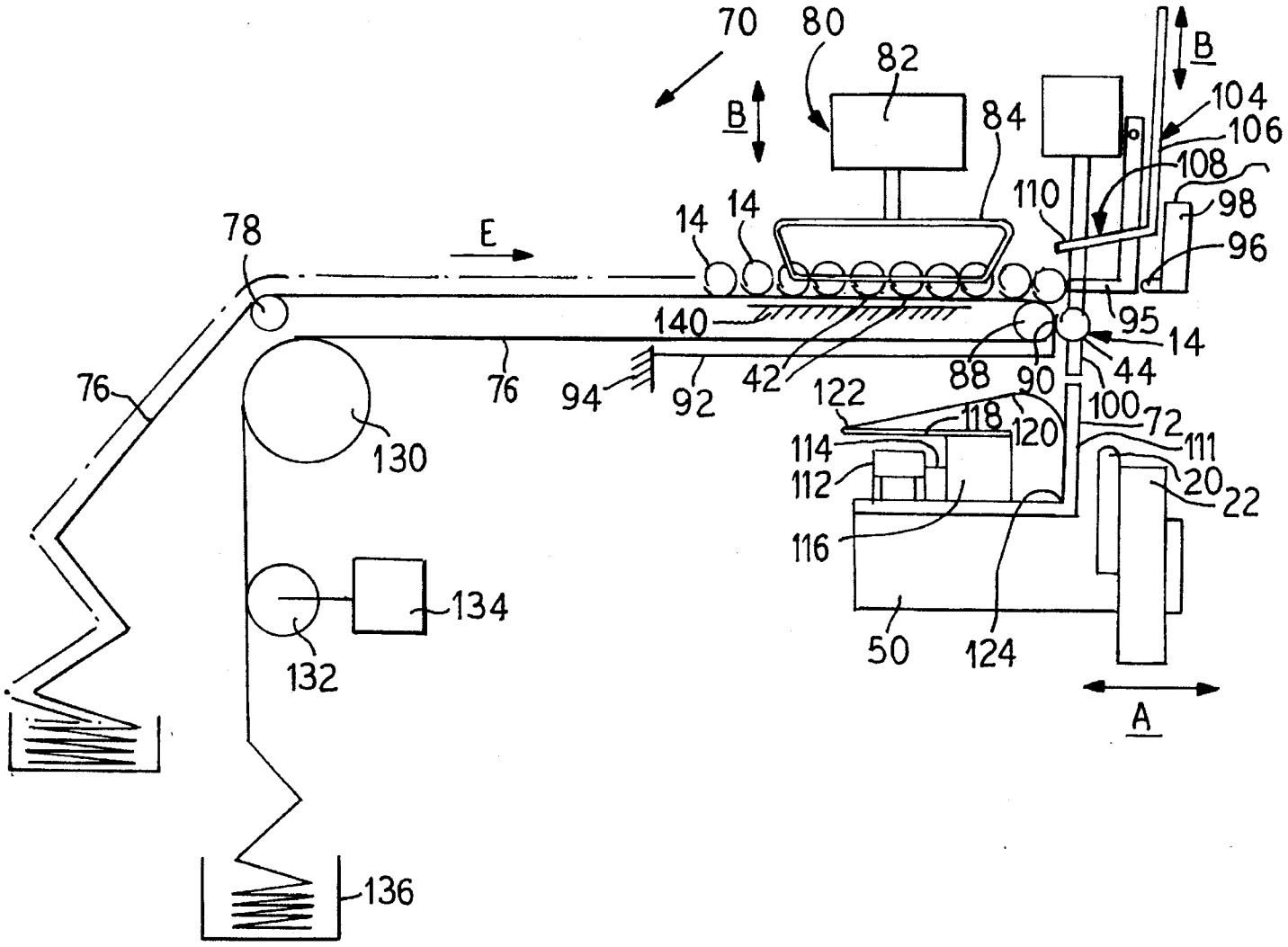
FIG. 14 is a schematic elevational view of an element feed apparatus.

FIG. 14 illustrates an element feed apparatus 70 which can be used to feed elements 14 onto an element holder 72 mounted to the carriage 50 with the driver 20 and the columnator 22 as previously described with regard to the holder 16. A transport belt such as a fan-folded paper carrier 76 having adhesive along two longitudinal stripes (not shown) holds a plurality of elements 14 along its length. A paper carrier system is also disclosed in U.S. Ser. No. 08/241,173 filed May 10, 1994 herein incorporated by reference. The paper carrier 76 with the elements is guided horizontally over a guide member 78 and located beneath a presser 80 having a weight 82 and two D-shaped tubular presses 84 which are arranged aligned with the adhesive stripes and which are located to pass between fingers 44 of the elements 14 and to overlie spines 42 of the elements 14. The presser 80 is reciprocal in the direction B.

The paper carrier 76 is curled around a turn bar 88. At approximately the three o'clock position 90 of the turn bar 88 the element 14 is removed from the paper carrier 76. Arranged in close contact with the paper at the three o'clock position 90 is an L-shaped spring lever 92 which is attached at an opposite end to stationary framework 94 of the apparatus 70. The lever 92 assists in separating the element 14 from the paper carrier 76 at this location. To control and synchronize the operation of the apparatus, a switch finger 95 senses the presence of an element to be dispensed from the paper carrier 76 and triggers a button 96 of an electrical switch 98. Alternatively, an optical sensor or other means can be used to sense the presence of the element to be dispensed.

A plurality of stationary dowels or pins 100 are arranged extending vertically and adjacent the turn bar 88. When an element proceeds downward around a perimeter of the turn bar 88 it becomes meshed with the plurality of dowels 100, one dowel between each finger 44 of the element 14. Located above the element 14 enmesh with the dowels 100 is a stripper 104 having a bar portion 106 connected to a rake portion 108. The rake portion 108 is also enmesh with the dowels 100 and has one tine 110 arranged above each finger 44 of the element 14. Below the dowels 100 is arranged the holder 72 which has holder tines 111 in registry with each of the dowels 100. On the holder 72 is arranged a solenoid linear actuator 112 having a push rod 114 connected to a foam "vice" or piston 116. On top of the vice 116 is arranged a plate 118. A spring element 120 having a general J-shape is connected at an end 122 by adhesive tape or other means and captured in a corner 124 of the L-shaped holder 72.

Figure 15:
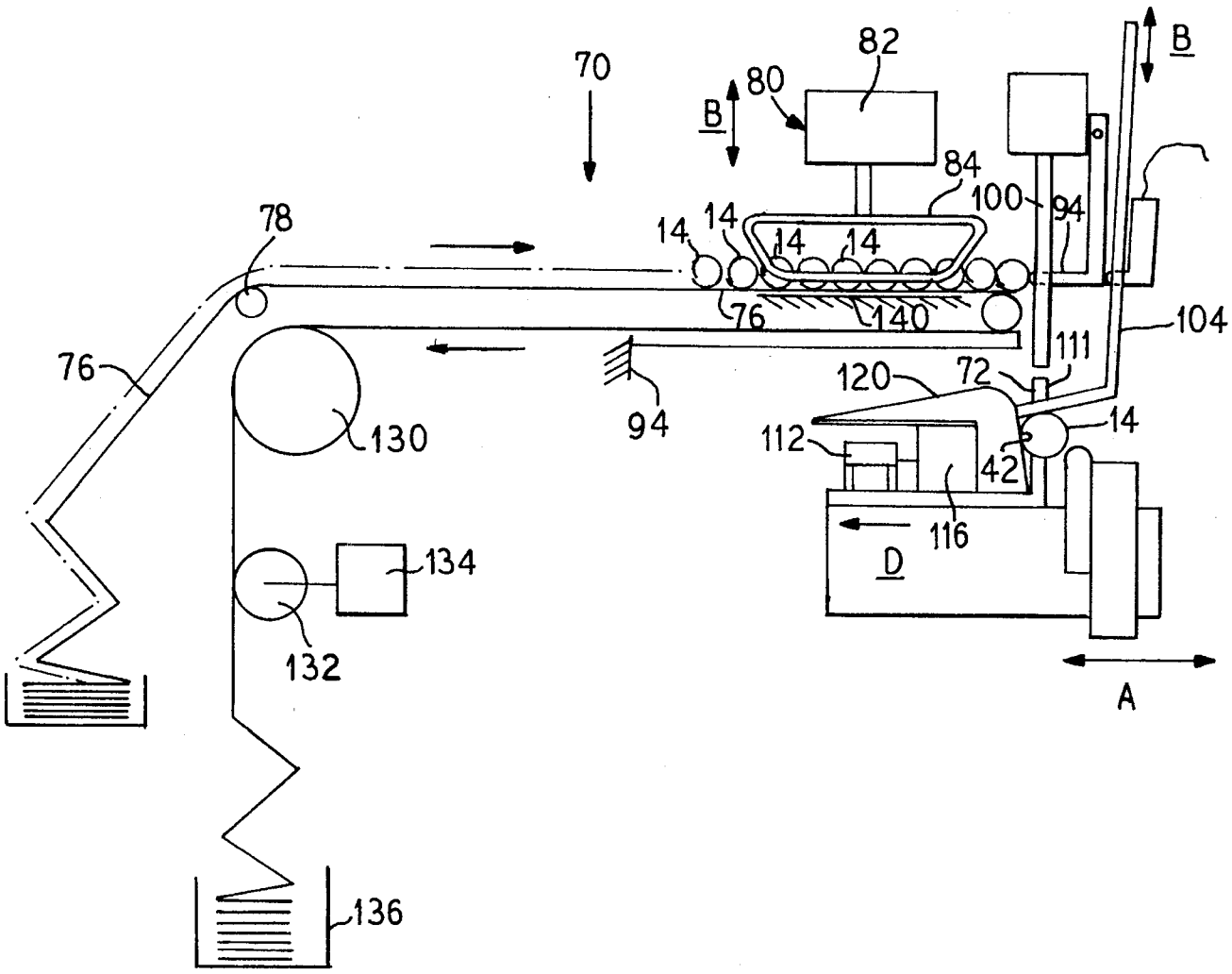
FIG. 15 is a schematic elevational view of the element feed apparatus of FIG. 14 in a further stage of operation.

Once the paper is wrapped around the turn bar 88 and the element 14 has been displaced therefrom using in part the dowels 100 and the lever 92, the paper carrier 76 proceeds to and around an idler drum 130 and downwardly to a tractor feed roller 132 driven preferably by a stepper motor 134, although other types of motors may be used. The paper can return to a bin 136 for recycling. FIG. 15 shows the apparatus of FIG. 14 in a further stage of operation wherein the weight 80 has been translated downwardly to hold the elements 14 against the paper carrier 76 and to stop progression of the paper against a frame surface 140 during displacing or stripping of the element 14 from the paper carrier 76.

The stripper 104 has been displaced downwardly in a direction B to force the element 14 down through the plurality of dowels 100 and onto the tines 111 of the holder 72. The solenoid 112 has been previously activated to move the foam vice 116 in the direction D away from the tines 111 of the holder 72 to relieve compressive stress on the spring 120 to allow the movement of the element 14 onto the tines 111 from above. After the element 14 is placed onto the tines 111 the solenoid 112 causes movement of the foam vice 116 in a direction reverse to the direction D to cause the spring 120 to clamp the spine 42 against the tines 111 of the holder 72. The foam vice allows a degree of resiliency to accommodate varying element sizes. The holder carriage 50 can now be moved in the direction A as described with regard in FIG. 1 and FIG. 2.

Operation

FIG. 1 illustrates an initial stage of operation wherein the element holder is at its furthest horizontal excursion from the paper (position Z) and the holder carriage 50 is in a down position. This allows the best access for loading the bind element 14 into the element holder 16, manually or by automated means. The element spring 18 is open to accept the element. The bind element 14 is placed into the element holder 16 with an open edge 42*a* of the spine 42 facing up. Both edges of the spine lay against a vertical surface 16*a* of the element holder. The bottom edge of the spine also rests on a horizontal surface 16*b* of the element holder located between tines 16*c* of the element holder. The fingers 44 (in their natural curled state) protrude towards the paper from between the element holder tines 16*c*.

The back stop 26 is down in a position to aid the alignment of the paper. The paper 12 rests on the platen 24. The edge 28 of the paper to be bound is against the back stop 26 and an edge perpendicular to the bind edge is against a side stop (not shown). The two stops position the paper so that a center of the pre-punched holes in the paper are aligned with a center axis of the guide fingers 34. The guide fingers 34 and clamp 32 are at their highest excursion above the paper 12. The columnator 22 and driver 20 are at their lowest excursion below the paper.

Figure 2:
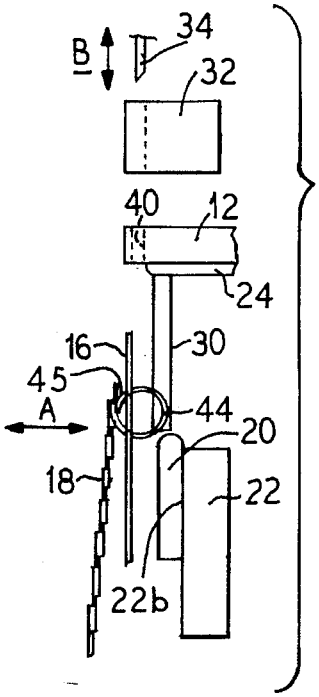
FIGS. 2–11 are schematic elevational views of the apparatus of FIG. 1 in progressive stages of operation.

FIG. 2 shows the element holder 16 moved forward in a direction A its full excursion so that a vertical plane made by the edges of the spine of the bind element (coincidental with the back side of the element holder fingers 16*a*) is positioned so that the path of the guide fingers B is as close to tangential as possible to the curve of the fingers 44 while still allowing the guide fingers 34 to clear the edge 42*a* of the spine.

Figure 3:
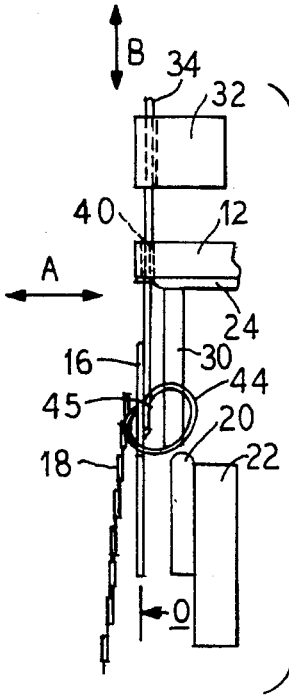

FIG. 3 illustrates the back stop now moved away while the element holder moves to position 0. This is to allow the paper to "float" in case the paper holes are not perfectly aligned with the guide fingers during the operation of FIG. 3.

FIG. 3 illustrates the guide fingers 34 having traveled their full excursion to their lowest point below the paper. In this movement, the guide fingers pass through the holes 40 in the paper 12 and enter the bind element 14 between the open edge 42*a* of the spine 42 and the outer curve of each finger 44.

Figure 4:
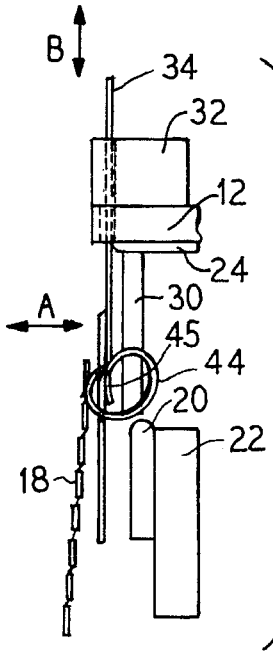

FIG. 4 illustrates the clamp 32 positioned downwardly to exert a spring governed force, trapping the paper 12 between the clamp 32 and the platen 24. This step occurs after the guide fingers pass through the paper to allow the paper to float during this step in case the holes are not perfectly aligned with the guide fingers. The paper needs to be clamped for three reasons: to resist the insertion force of the bind element fingers into the paper holes, to resist the spring force of the bind element fingers when the guide fingers release them before their tension is relieved by the forward movement of the element holder to a position Y, and to retain the bind element/paper combination as the element holder strips away from the element.

Figure 5:
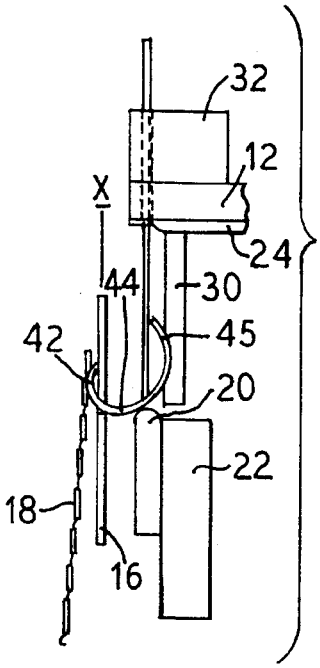

FIG. 5 illustrates the-element holder moving back horizontally to position X. In doing so, the fingers 44 tension against the curved edge of the guide fingers until the tips 45 of the element fingers 44 "snap" over center (at the 9:00 position) and start to climb up the fingers as they are tensioned more. The concave surface of the guide fingers 34 trap the pointed tips 45 of the element fingers 44 and keep them on the guide fingers. In addition, the stabilizing fingers 30 trap the outer curve of the element fingers and keep the entire finger from skewing sideways. Position X of the element holder 16 is different for each size bind element. It is defined as the position that stretches the element fingers 44 on the guide fingers 34 so as to flatten out the curve of the element fingers 44 as much as possible without starting to reverse the movement of the tips 45 of the element fingers 44 downwards on the guide fingers.

Figure 6:
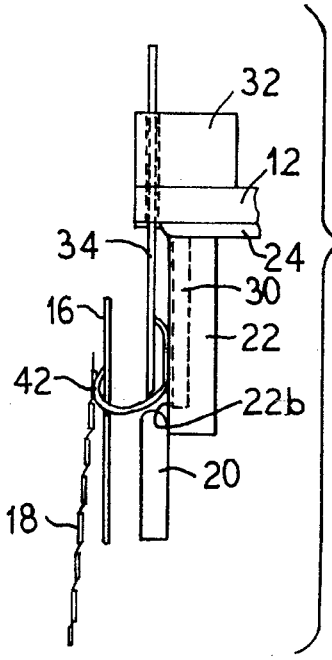

FIG. 6 illustrates the columnator 22 having traveled its full excursion up toward the paper. In doing so, the columnator 22 further flattens the curve of the element fingers 44 to within the gap between the plane of the columnator and the concave surface of the guide fingers 34. This gap equals the free space in the paper holes with the guide fingers in the holes, plus the distance the curved surface 54 on the bottom of the platen 24 is able to flatten the element fingers 44.

Figure 7:
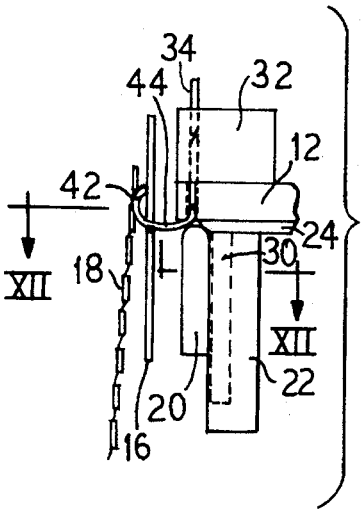

FIG. 7 illustrates the driver 20 having proceeded up vertically to within a vertical distance from the tips 46 of the guide fingers 34, equal to the thickest binding element plastic stock. This presents a vertical trap inhibiting the bind element fingers 44 from moving away from the guide fingers 34. The driver 20 continues up with the holder carriage 50 and the guide fingers 34 moving in unison with the driver 20 from this point on. The movement of these components direct the bind element fingers up through the paper holes while the guide fingers retreat upwardly. The bottom of the platen has the curved surface 54 to help perform the last flattening of the element finger's curvature before they enter the paper holes.

Figure 8:
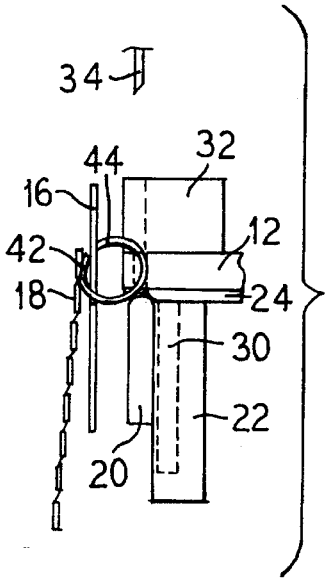

FIG. 8 illustrates the guide fingers 34 continuing up to their farthest position above the paper, moving relative to the now stopped holder carriage 50 and driver 20 and in doing so release the tips 45 of the element fingers 44 allowing them to return toward their natural curvature.

Figure 9:
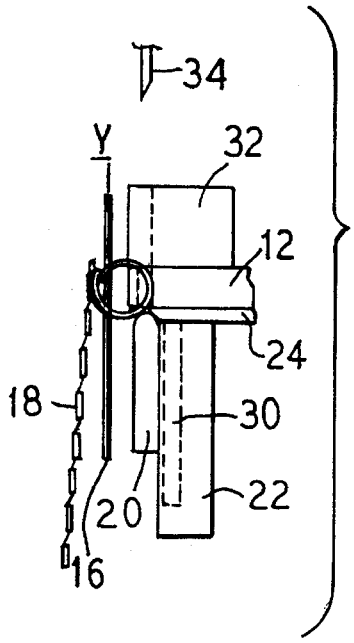

FIG. 9 illustrates the element holder having translated horizontally to position Y, bringing the spine 42 of the bind element 14 closer to the holes 40 in the paper 12 through which the bind element fingers now protrude. Position Y is defined for each bind element size as the point at which all tension on the bind element fingers is relieved and the fingertips again rest in their natural curl under the lip of the element spine.

Figure 10:
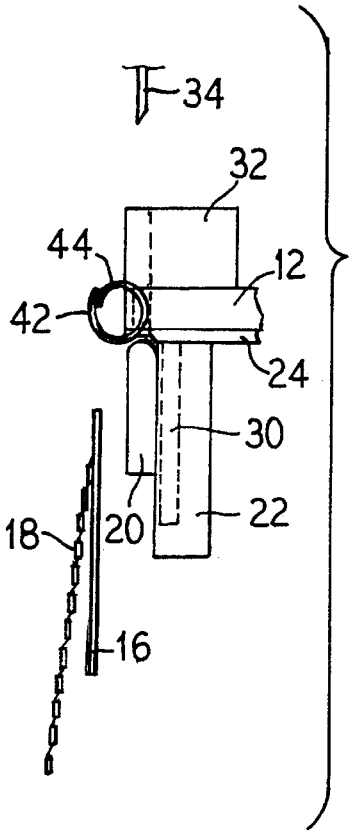

FIG. 10 illustrates the element holder 16, driver 20 and columnator 22 moving down away from the paper. In doing so, the bind element stays on the paper, retained by its own spring force, the paper in turn stays on the platen 24 retained by the force of the clamp 32 and the holder strips free of the element. If, rather than an element spring, an actuator control latch was used, this latch would be opened and released before the downward movement of the element holder, driver and columnator.

Figure 11:
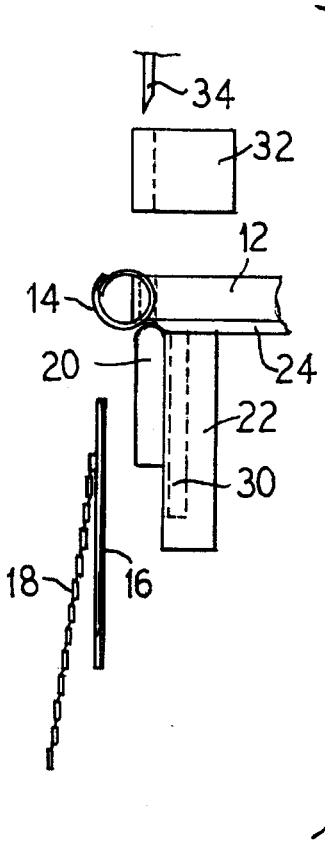

Finally, FIG. 11 illustrates the clamp being translated to its highest position above the paper freeing the document to be removed manually or by automated means.

The operation of the element loading apparatus 70 is described with regard to FIGS. 14 and 15. In operation, the paper carrier 76 is moved in the direction E in indexing fashion as individual elements 14 are stripped from the paper. During stripping, a D-shaped presser 84 moves down in the direction B to hold the elements and the paper tight against the frame 140 as the stripper 104 in conjunction with the lever 92 strips an element 14 off the paper, down through the plurality of dowels 100 which act to guide and maintain orientation of the element 14 and onto the comb-shaped holder 72 to thereafter be clasped by the spring 120 to the tines 111 of the holder 72. The spring 120 is activated by a solenoid 112 to be loose during the installation of the element 14 onto the holder 72 and thereafter be clamped more tightly for the succeeding operation of spreading the element for threading onto the pages. The foam vice 116 is utilized to allow some degree of flexibility in the clamping of elements of different sizes. The idle roller 130 has grooves applied around a circumference thereof so that the adhesive strips on the paper (not shown) do not stick to the idle roller 130, i.e., the strips of adhesive are in registry with the grooves around the circumference of the roller 130. The turn bar 88 is usually a small diameter such as ⅜ inch which only presents one bind element 14 at a time along its vertical tangent.

The motor 134 moves the pin feed tractor 132, advancing the paper carrier until a bind element is sensed by the switch finger 94. The motor 134 continues a pre-set distance from that point and then stops. The additional movement is due to the fact that the switch finger cannot physically be located exactly where the element should stop (three o'clock position 90). The proper position for the element is so that it projects away from the turn bar perpendicular to the path of the element stripper 104. The weight 80 drops by gravity onto the inactive elements. The stripper is allowed to drop vertically on its own weight, pushing the bind element free from the adhesive of the paper carrier 76 with an impact shearing force. The weight 80 prevents the stripping action from advancing the paper during this action. The loose element 14 is guided vertically by the element spring 120 and the dowel pins 100. The element is pushed to the bottom of the holder tines 111. The gravity drive during this step prevents component and product damage by limiting the available downward force. For the next succeeding element the stripper 104 is lifted by means not shown to its original position so that it may act upon the next succeeding element when called upon.

The synchronized movements of the components of the apparatus 10 ensues by known means such as mechanically, such as by gears, or electrically such as by a programmable controller. Electric motors, pneumatics, hydraulics or other drivers can be used to move the components.

Although the present invention has been described with reference to a specific embodiment, those of skill in the art will recognize that changes may be made thereto without departing from the scope and spirit of the invention as set forth in the appended claims.

We claim as our invention:

1. An apparatus for binding a plurality of pages with a binding element having a spine and a plurality of spaced apart curled fingers extending from the spine, comprising:

a platen for holding the plurality of pages in a stacked arrangement, the plurality of pages having a row of pre-punched holes adjacent a first transverse edge;

a means for retaining said spine of said element laterally;

a plurality of guide fingers arranged reciprocally above said holes and protrudable downwardly through said holes to engage said curled fingers, said means for retaining said spine translatable laterally with said spine to spread curled fingers away from said spine of said element;

means for flattening said curled fingers, said means for flattening translatable toward said plurality of pages on a side of said plurality of pages opposite said guide fingers; and means for driving said curled fingers through said holes.

2. The apparatus according to claim 1, wherein said means for retaining comprises a comb-shaped element holder enmesh with said curled fingers and retaining said spine on one side thereof, and a spring member on an opposite side of said spine clasping said spine between said spring member and said comb-shaped element holder.

3. The apparatus according to claim 1, wherein said means for flattening said curled fingers comprises a columnator reciprocal toward and away from said plurality of pages and having a side facing said curled fingers opposite said guide fingers, reciprocation of said columnator toward said plurality of pages pressing said curled fingers and flattening said curled fingers against said guide fingers; and said means for driving comprises a drive member arranged below said curled fingers and reciprocal to push said curled fingers toward and through said holes.

4. The apparatus according to claim 1 further comprising a plurality of stabilizing fingers extending from said platen in parallel with said guide fingers and arranged to transversely guide said curled fingers engaged with said guide fingers.

5. The apparatus according to claim 4, wherein said stabilizing fingers are circular in cross section and arranged on opposite transverse sides of each curled finger, and said means for flattening comprises a columnator which has openings to intermesh with said stabilizing fingers during flattening of said curled fingers.

6. The apparatus according to claim 1 further comprising a means for clamping the plurality of pages on said platen.

7. The apparatus according to claim 1 further comprising a back stop movably arranged to orient and locate said plurality of pages on said platen.

8. The apparatus according to claim 1 further comprising a means for successively loading elements onto said means for retaining said spine, said means for successively loading comprising:

a transport belt successively translating said elements to a loading station;

a guide means for guiding the curled fingers away from said transport belt onto said means for retaining said spine;

a stripper for translating the element successively from said belt along said guide means and onto said means for retaining said spine.

9. A method of threading a binder element through a plurality of holes arranged in a stack of pages to bind the pages, the element having a transverse spine and curled spaced apart fingers forming rings, comprising the steps of:

holding the spine on a first side of the pages to be bound; inserting a plurality of guide fingers through the holes of the stack of pages to be bound from a second side opposite to the first side;

engaging with the guide fingers the free ends of the curled fingers;

moving laterally the spine member while retaining with the guide fingers free ends of the curled fingers to open the binder element;

flattening the curled fingers;

driving the curled fingers from the first side toward the second side through said holes;

releasing the spine to allow the binder element to resume its closed configuration.

10. The method according to claim 9 comprising the further step of clamping the stack of pages during the driving of the curled fingers through said holes and maintaining the clamping until the spine is released.

11. The method according to claim 9, wherein said step of flattening comprises the steps of:

retaining the curled fingers transversely to prevent displacement;

moving a columnator from said first side toward said second side against said curled fingers on a side of said curled fingers opposite said guide fingers to flatten said curled fingers against said guide fingers; and reciprocating a drive member from beneath the flattened curled fingers to displace the flattened curled fingers through said holes.

12. The method according to claim 9, wherein during the step of driving the curled fingers through said holes, said spine of said binder element is simultaneously moved in a direction from said first side toward said second side.

13. An apparatus for binding a stack of pages having pre-punched holes with a binding element having curled fingers forming rings, comprising:

a means for holding a stack of pages;

a plurality of guide fingers arranged to proceed through said pre-punched holes and to engage tips of said curled fingers;

a means for retaining a portion of said curled fingers, said means for retaining movable laterally to open said fingers;

a means for flattening said tips of said curled fingers; and a means for driving said tips through said holes.

14. The apparatus according to claim 13, wherein said guide fingers have concave cross section at an end region locatable below said stack and facing said tips to guide said curled fingers.

15. The apparatus according to claim 13, wherein said means for flattening comprises a member reciprocatable toward and away from said stack and which compresses said curled fingers against said guide fingers.

16. The apparatus according to claim 13, wherein said means for retaining comprises a comb-shaped element holder for meshing with said element and a clamp means for holding said element onto said holder.

17. The apparatus according to claim 13, wherein said means for holding said stack of pages comprises a platform supporting said stack having an open area beneath said holes and curved wall portions for guiding said tips into said holes.

18. The apparatus according to claim 13, wherein said means for holding said stack of pages comprises:

a platform for supporting said stack;

at least one movable end stop for aligning the pages of the stack on the platform; and a clamp arranged on a side of said stack opposite said platform to clamp said stack to said platform.

19. An apparatus for binding a stack of pages having pre-punched holes with a binding element having curled fingers forming rings, comprising:

a transport belt means for delivering successive binding elements to a loading area;

a stripper means for successively removing binding elements from the belt means;

an element holder having a comb-shaped element retainer, said stripper means aligned with the element retainer to load the element thereon, said holder moveable from the loading area to a binding area;

a means for holding a stack of pages;

a plurality of guide fingers arranged to proceed through said pre-punched holes and to engage tips of said curled fingers;

a means for uncurling and flattening said tips of said curled fingers; and a means for driving said tips through said holes.

20. The apparatus according to claim 19, wherein said stripper means comprises:

a turn bar, said belt means partially wrapped around said turn bar;

a strip lever having a portion closely interfering with said belt means opposite said turn bar; and a rake arranged to reciprocate vertically to force successive elements against said strip lever to be displaced from said belt means onto said element holder.

21. The apparatus according to claim 20 further comprising a reciprocating weight means to clamp the belt means to stationary structure upstream of said strip lever to prevent belt means movement during stripping of each successive element.

22. The apparatus according to claim 20 further comprising guide dowels arranged in mesh with said rake and in registry with said element retainer.

* * * * *